US006852211B2

(12) United States Patent
Kondo et al.

(10) Patent No.: US 6,852,211 B2
(45) Date of Patent: Feb. 8, 2005

(54) NICKEL ELECTROPLATING SOLUTION

(75) Inventors: Makoto Kondo, Kounosu (JP); Haruki Enomoto, Hasuda (JP); Motoya Shimazu, Saitama (JP)

(73) Assignee: Shipley Company, L.L.C., Marlborough, MA (US)

( * ) Notice: Subject to any disclaimer, the term of this patent is extended or adjusted under 35 U.S.C. 154(b) by 190 days.

(21) Appl. No.: 10/330,419

(22) Filed: Dec. 27, 2002

(65) Prior Publication Data

US 2003/0213699 A1 Nov. 20, 2003

(30) Foreign Application Priority Data

Dec. 28, 2001 (JP) ..... 2001-399721

(51) Int. Cl.[7] ..... C25D 3/12; C23C 16/00
(52) U.S. Cl. ..... 205/280; 205/271; 106/1.27
(58) Field of Search ..... 106/1.27; 205/50, 205/271, 280; 428/544, 689

(56) References Cited

U.S. PATENT DOCUMENTS 3,617,343 A * 11/1971 Kandler et al. ..... 427/305
3,672,940 A * 6/1972 Funada et al. ..... 427/306
4,421,611 A * 12/1983 Cameron ..... 205/275
2003/0196906 A1 10/2003 Kondo et al. ..... 205/271

FOREIGN PATENT DOCUMENTS

GB 1408748 A * 10/1975 ..... C23B/5/08

OTHER PUBLICATIONS

References A, B and N were cited on the European Search Report.*

* cited by examiner

*Primary Examiner*—Edna Wong
(74) *Attorney, Agent, or Firm*—S. Matthew Cairns

(57) ABSTRACT

Nickel plating baths that efficiently deposit layers of nickel on only the parts to be plated without corroding electronic parts that are ceramic composites or ceramic parts containing transition metal oxides are provided. Such nickel plating baths contain at least two chelating agents selected from amino polycarboxylic acids, polycarboxylic acids, and polyphosphonic acids, and have a pH in the range of 5 to 7, and a ratio of nickel ions to chloride ions of greater than 1.

6 Claims, No Drawings

NICKEL ELECTROPLATING SOLUTION

BACKGROUND OF THE INVENTION

This invention generally pertains to the field of nickel plating. More particularly, this invention pertains to a nickel plating solution that can be used for ceramic composite materials, a plating method using this plating solution, and the products obtained thereby.

Nickel plating is widely used in the electronics industry as a ground for plating such as tin plating, solder plating, or gold plating. A strongly acidic nickel plating solution such as a vat bath, totally chloride bath, sulfaminic acid bath, or boron fluoride bath is conventionally used to deposit nickel in such applications. Even in electronic parts such as chip resistors or chip capacitors that are ceramic composites, a vat bath or sulfaminic acid bath is conventionally used to provide the nickel under layer for tin plating or solder plating.

In recent years, many new products that are ceramic composites containing transition metal oxides have been developed and are widely used in the electronic industry. Using the conventional strongly acidic nickel plating baths for plating special electronics parts that are ceramic composites containing transition metal oxides, however, has the problem that the ceramic part is corroded by the nickel plating solution. Consequently, reducing corrosion of parts easily corroded by conventional acidic nickel plating solutions has been attempted, and various plating solutions have been reported. All of these, however, are neutral to alkaline, contain a high concentration of potent complexing agents for maintaining nickel ions in the plating solution, and have the problems of reduced plating efficiency and reduced ease of operation. These plating baths also have the problem that even when only the electrodes of electronic parts having ceramic base materials require plating, plating spreads beyond these electrode parts to the surrounding ceramic parts, and thus damages the characteristics of these parts. In addition, just having a pH of about 4 to 7 causes corrosion of ceramic parts, reduces plating efficiency, reduces the power to keep nickel ions in the bath, and produces sediment in the form of hydroxides.

SUMMARY OF THE INVENTION

The purpose of this invention is to solve the problems described above by providing a nickel plating solution that is a weakly acidic aqueous solution capable of efficiently nickel-plating only the parts to be plated without corroding electronic parts that are ceramic composites or ceramic parts containing transition metal oxides such as ferrite. This invention also provides a plating method using said nickel plating solution, and products obtained by such a plating method, especially electronic parts such as chip resistors or chip capacitors.

This invention offers a nickel electroplating solution containing: a) nickel ions, and b) at least two chelating agents selected from the group consisting of amino polycarboxylic acids, polycarboxylic acids, and polyphosphonic acids, wherein the solution has a pH in a range of 5 to 7, and a ratio of nickel ions to chloride ions ($Ni^{2+}/Cl^{-}$) of greater than 1.

DETAILED DESCRIPTION OF THE INVENTION

The terms "nickel plating solutions" and "nickel plating baths" are used interchangeably throughout this specification. The following abbreviations shall have the following meanings unless the context clearly indicates otherwise: EDTA=ethylenediamine tetraacetic acid; g/L=grams per liter; ° C.=degrees Centigrade; A/dm$^2$=amperes per square decimeter; $\mu$m=micron=micrometer; and mol/L=moles per liter.

The concentration of nickel ions in the present plating solutions is typically 1 to 100 g/L, more typically 10 to 50 g/L, and even more typically 10 to 30 g/L. Concentrations of nickel ions above and below this range may also be suitably used. However, too low a concentration of nickel ions tends to provide a burned deposit on parts of the product being plated that are in areas of high current density. Too high a concentration of nickel ions reduces stability in the plating solution and produces insoluble compounds in the form of hydroxides.

The ratio of nickel ions to chloride ions ($Ni^{2+}/Cl^{-}$) in the plating solution of this invention is greater than 1. This means that nickel chloride is not the main ingredient serving as a source of nickel ions, and at least 50% of nickel is supplied by nickel sources other than nickel chloride. Preferably, the ratio of nickel ions to chloride ions is greater than 5. In one embodiment, the plating solution does not contain nickel chloride as a source of nickel ions. A wide variety of sources of nickel ions may be used. Such sources of nickel ions are typically soluble in the plating bath used. Typically, the source of nickel ions is at least one nickel salt selected from nickel sulfate and nickel sufaminate, and preferably nickel sulfate. Mixtures of nickel ion sources may be used in the present plating baths.

The present nickel plating solutions contain at least two chelating agents selected from the group consisting of amino polycarboxylic acids, polycarboxylic acids, and polyphosphonic acids. Exemplary amino polycarboxylic acids include, but are not limited to, ethylimino-N,N-diacetic acid, glycine, iminodiacetic acid, hydroxyethyl-ethylenediamine triacetic acid, nitrilotriacetic acid, EDTA, triethylenediamine tetraacetic acid, glutaminic acid, aspartic acid, beta-alanine N,N-diacetic acid, and tricarbarylic acid. Suitable polycarboxylic acids include, without limitation, malonic acid, maleic acid, ascorbic acid, gluconic acid, succinic acid, malic acid, and tartaric acid. Exemplary polyphosphonic acids include, without limitation, aminotrimethylene phosphonic acid, hydroxyethylidene diphosphonic acid, and ethylenediamine tetramethylene phosphonic acid. The preferred polyphosphonic acid is aminopolyphosphonic acid. In a particular embodiment, the chelating agents are at least two compounds selected from iminodiacetic acid, ascorbic acid, and aminotrimethylene phosphonic acid. Other suitable chelating agents may also be used.

The total amount of the chelating agents in the present plating baths is typically from 0.01 to 3 mol/L, and more typically 0.1 to 0.5 mol/L. Any ratio of the two chelating agents may be used, and such ratio can be set appropriately based on conditions such as the content of nickel and the source of nickel ions used. Such selection is well within the ability of one skilled in the art.

In general, the present plating solutions have a pH of 5 to 7. This pH region produces a satisfactory plating solution having very good plating efficiency, and can effectively inhibit corrosion even of substrate materials such as ceramics. In addition, a fine deposit having a high barrier effect can be obtained without adding organic additives. However, such organic additives, such as brighteners and surface active agents, may be added if desired. Other suitable organic additives may be used and are well known to those skilled in the art.

The pH can be maintained by a variety of means. Any desired acid or base can be used, and any of an inorganic acid, organic acid, inorganic base, or organic base can be used. Besides acids such as sulfuric acid, hydrochloric acid, or sulfaminic acid, acids used as chelating agents such as acetic acid or ascorbic acid can also be used. Besides inorganic bases such as sodium hydroxide or potassium hydroxide and organic bases such as various types of amines, bases such as basic nickel carbonate can also be used. In addition, a pH buffering ingredient such as boric acid can be used if the pH tends to fluctuate due to operating conditions.

The present nickel plating solutions may be prepared by combining the source of nickel ions (or sources of nickel ions) with the at least two chelating agents and water in any order. Any organic additives used may be combined with the above components in any order.

There are no restrictions on the object to be plated, and any desired substrate can be plated. Electronic parts such as chip resistors or chip capacitors that are ceramic composite materials are ideally plated using the present plating bath. In particular, the present plating solution can deposit nickel layers on ceramic composite materials without corroding the substrate material.

This invention also provides a method of depositing a nickel layer using the above described plating solution. Standard plating conditions may be used to deposit a layer of nickel using the present plating baths. In general, a wide variety of electrolytic plating conditions may be employed. For example, the present plating solution can be used for either direct or pulse-plating. As required, the plating solution can be agitated by a flow method such as air agitation, cathode oscillation, or a pump. Metallic nickel is normally used as the anode, but an insoluble electrode such as a platinum-plated titanium plate can be used in some cases. The bath temperature is normally 10° C. to 80° C., and preferably 30° C. to 65° C. Plating conditions and their effects are well-known, and are matters that can be set as appropriate by persons skilled in the art according to the desired performance.

Layers of nickel are deposited on such substrates by contacting the substrate to be plated with the above described nickel plating-bath, and subjecting the plating bath to sufficient current density for a period of time sufficient to deposit a layer of nickel. A wide variety of current densities may be used. Exemplary current densities include, but are not limited to, those in the range of 0.01 to 1 A/dm$^2$. When pulse-plating is used, typical current densities are in the range of 0.05 to 0.2 A/dm$^2$, however current densities above or below this range may also be used. The plating time varies depending on the nickel layer thickness desired, but is normally about 10 to 120 minutes.

Examples of this invention will be described below, but such descriptions are no more than examples, and do not in any way limit the scope of this invention.

WORKING EXAMPLE 1

A nickel plating bath is prepared by combining the following components in the amounts listed.

| | |
|---|---|
| nickel sulfate hexahydrate | 91 g/L |
| aminotrimethylene phosphonic acid | 100 g/L |
| ascorbic acid | 50 g/L |
| pH (buffered by NaOH) | 5.0 |

WORKING EXAMPLE 2

A nickel plating bath is prepared by combining the following components in the amounts listed.

| | |
|---|---|
| nickel sulfaminate tetrahydrate | 140 g/L |
| aminotrimethylene phosphonic acid | 50 g/L |
| ascorbic acid | 50 g/L |
| pH (buffered by NaOH) | 5.0 |

WORKING EXAMPLE 3

A nickel plating bath is prepared by combining the following components in the amounts listed.

| | |
|---|---|
| nickel sulfate hexahydrate | 91 g/L |
| aminodiacetic acid | 50 g/L |
| ascorbic acid | 20 g/L |
| pH (buffered by NaOH) | 5.0 |

WORKING EXAMPLE 4

A nickel plating bath is prepared by combining the following components in the amounts listed.

| | |
|---|---|
| nickel sulfate hexahydrate | 91 g/L |
| aminotrimethylene phosphonic acid | 100 g/L |
| ascorbic acid | 50 g/L |
| pH (buffered by NaOH) | 7.0 |

WORKING EXAMPLE 5

A nickel plating bath is prepared by combining the following components in the amounts listed.

| | |
|---|---|
| nickel sulfate hexahydrate | 91 g/L |
| aminotrimethylene phosphonic acid | 100 g/L |
| ascorbic acid | 50 g/L |
| boric acid | 50 g/L |
| pH (buffered by NaOH) | 7.0 |

COMPARATIVE EXAMPLE 1

A nickel plating bath is prepared by combining the following components in the amounts listed.

| | |
|---|---|
| nickel sulfate hexahydrate | 350 g/L |
| nickel chloride hexahydrate | 45 g/L |
| boric acid | 50 g/L |
| pH | 4.2 |

COMPARATIVE EXAMPLE 2

A nickel plating bath is prepared by combining the following components in the amounts listed.

| | |
|---|---|
| nickel sulfate hexahydrate | 350 g/L |
| ascorbic acid | 100 g/L |
| pH | 9.0 |

COMPARATIVE EXAMPLE 3

A nickel plating bath is prepared by combining the following components in the amounts listed.

| | |
|---|---|
| nickel sulfate hexahydrate | 91 g/L |
| ascorbic acid | 100 g/L |
| pH | 5.0 |

COMPARATIVE EXAMPLE 4

A nickel plating bath is prepared by combining the following components in the amounts listed.

| | |
|---|---|
| nickel sulfate hexahydrate | 91 g/L |
| aminotrimethylene phosphonic acid | 100 g/L |
| pH | 5.0 |

COMPARATIVE EXAMPLE 5

A nickel plating bath is prepared by combining the following components in the amounts listed.

| | |
|---|---|
| nickel sulfate hexahydrate | 91 g/L |
| aminodiacetic acid | 100 g/L |
| pH | 5.0 |

COMPARATIVE EXAMPLE 6

A nickel plating bath is prepared by combining the following components in the amounts listed.

| | |
|---|---|
| nickel sulfate hexahydrate | 350 g/L |
| nickel chloride hexahydrate | 45 g/L |
| boric acid | 50 g/L |
| pH | 6.0 |

PLATING EXAMPLE

Nickel layers are deposited using each of the plating solutions described above under the following plating conditions:

| | |
|---|---|
| plating object: | chip product made of ceramics |
| plating method: | pulse-plating |
| solution temperature: | 50° C. |
| cathode current density: | 0.05 to 0.2 A/dm$^2$ |

The results of the nickel plating experiments are shown in the following table. The thickness of these plating films was observed by a cross-section analysis and the results are also reported in the Table. In the Table, the symbols have the following meanings: "-" means not analyzed; "○" means good; "x" means failed; and "Δ" means fair or partially.

TABLE

| Example | Bath Stability | Corrosion of Ceramic Part | Deposition on Ceramic Part | Deposited Film Appearance | Deposited Film Thickness (μm) |
|---|---|---|---|---|---|
| Working Example 1 | ○ | ○ | ○ | semi-glossy, uniform | 5.7 |
| Working Example 2 | ○ | ○ | ○ | semi-glossy, uniform | 5.3 |
| Working Example 3 | ○ | ○ | ○ | semi-glossy, uniform | 5.8 |
| Working Example 4 | ○ | ○ | ○ | semi-glossy, uniform | 6.0 |
| Working Example 5 | ○ | ○ | ○ | semi-glossy, uniform | 5.5 |
| Comparative Example 1 | ○ | x | Δ | semi-glossy, uniform | 6.0 |
| Comparative Example 2 | ○ | x | Δ | semi-glossy, uniform | 5.0 |
| Comparative Example 3 | ○ | x | Δ | semi-glossy, uniform | 1.5 |
| Comparative Example 4 | x | — | — | — | — |
| Comparative Example 5 | Δ | ○ | ○ | semi-glossy, uniform | 1.0 |
| Comparative Example 6 | x | — | — | — | — |

All of the films obtained by the working examples had a uniform non-glossy or fine glossy appearance. From the experiment results, it can be seen that using the plating solution of this invention can efficiently nickel-plate only the part to be plated without corroding the ceramic substrate part.

What is claimed is:

1. A nickel electroplating solution, consisting essentially of:

a) nickel ions, b) optional chloride ions, c) at least two different chelating agents selected from the group consisting of amino polycarboxylic acids, polycarboxylic acids, and polyphosphonic acids, d) water, and e) an optional pH maintenance compound wherein the solution has a pH in a range of 5 to 7, and a ratio of nickel ions to chloride ions of greater than 1 when chloride ions are present in the solution.

2. The nickel electroplating solution of claim 1, wherein the amino polycarboxylic acid is iminodiacetic acid, the polycarboxylic acid is ascorbic acid, and the polyphosphonic acid is aminotrimethylene phosphonic acid.

3. The nickel electroplating solution of claim 1 wherein the pH maintenance compound is a buffering agent.

4. A method for depositing a layer of nickel on a ceramic substrate comprising contacting the ceramic substrate to be plated with a nickel plating solution comprising a source of nickel ions, and at least two different chelating agents selected from the group consisting of amino polycarboxylic acids, polycarboxylic acids and polyphosphonic acids, wherein the solution has a pH of 5 to 7 and a ratio of nickel ions to chloride ions of greater than 1 when chloride ions are present in the solution and subjecting the nickel plating solution to sufficient current density for a period of time sufficient to deposit a layer of nickel on the ceramic substrate without corroding the ceramic substrate.

5. The method of claim 4 wherein the substrate is a ceramic composite material.

6. The method of claim 4 wherein the solution further comprises a buffering agent.

* * * * *